United States Patent [19]

McLaughlin et al.

[11] 4,395,347

[45] Jul. 26, 1983

[54] POWDERED CARPET CLEANER CONTAINING ETHER ALCOHOL SOLVENTS

[75] Inventors: James H. McLaughlin, Vero Beach, Fla.; Stephen V. Dente, Lodi, N.J.; Robert Carmello, Dumont, N.J.; James A. Smith, Old Tappan, N.J.

[73] Assignee: Airwick Industries, Inc., Carlstadt, N.J.

[21] Appl. No.: 258,481

[22] Filed: Apr. 28, 1981

Related U.S. Application Data

[63] Continuation of Ser. No. 100,175, Dec. 4, 1979, abandoned.

[51] Int. Cl.[3] ..... C11D 3/02; C11D 7/04

[52] U.S. Cl. ..... 252/139; 252/88; 252/135; 252/140; 252/528; 252/174.25; 252/174.11; 252/174.13; 252/174.21; 252/531; 252/532; 252/539

[58] Field of Search ..... 252/8.6, 88, 89.1, 135, 252/139, 140, 528, 531, 532, 539, 174.13; 8/137

[56] References Cited

U.S. PATENT DOCUMENTS

| | | | |
|---|---|---|---|
| 879,902 | 2/1908 | Prusz | 252/88 |
| 1,264,104 | 4/1918 | McComb et al. | 252/139 |
| 2,213,641 | 9/1940 | Tainton | 252/174.25 |
| 2,344,268 | 3/1944 | Rench | 252/163 |
| 3,418,243 | 12/1968 | Hoxie | 252/154 |
| 3,533,942 | 10/1970 | Rhees et al. | 252/8.8 |
| 3,549,545 | 12/1970 | Stolmeiger | 252/163 X |
| 3,736,259 | 5/1973 | Buck | 252/140 X |
| 3,839,214 | 10/1974 | Schwalley et al. | 252/106 |
| 4,035,148 | 7/1977 | Metzger et al. | 8/137 |
| 4,090,974 | 5/1978 | Morganson | 252/135 |
| 4,161,449 | 7/1979 | Smith et al. | 252/8.6 |
| 4,244,834 | 1/1981 | Schwalley et al. | 252/106 |

FOREIGN PATENT DOCUMENTS

| | | |
|---|---|---|
| 2240287 | 4/1975 | France . |
| 2401983 | 3/1979 | France . |
| 44-8108 | 4/1969 | Japan . |
| 1114697 | 5/1968 | United Kingdom . |

*Primary Examiner*—P. E. Willis, Jr.
*Attorney, Agent, or Firm*—Harry Falber

[57] ABSTRACT

A pulverulent composition for rug and carpet maintenance and cleaning formed by mixing approximately 40.0 to 98.5% by weight, of a borax carrier with a primary cleaning system comprising approximately 1.0 to 10.0%, by weight, of an ether alcohol cleaning solvent and approximately 0.5 to 10.0%, by weight, of surfactant, together with optional ingredients such as an antistatic agent.

26 Claims, No Drawings

POWDERED CARPET CLEANER CONTAINING ETHER ALCOHOL SOLVENTS

This is a continuation of application Ser. No. 100,175 filed on Dec. 4, 1979, now abandoned.

This invention relates to new carpet cleaning compositions and to a new method for the maintenance of rugs and carpets.

A variety of carpet cleaning compositions are available on the market. Most of these formulations are composed of resins and surfactants and are dispersed in liquid or aerosol forms. For example, French Pat. No. 2,272,216 describes the cleaning as well as the antistatic and antisoiling dressing of textile materials such as rugs and carpets by means of foaming aqueous emulsions which, upon drying, leave on the fiber a solid nonsticky residue which can be removed by means of brushing or vacuuming.

This method of cleaning, as representative of the use of such liquid formulations, has the drawback that it wets the surface fibers to a fairly considerable extent, and sometimes penetrates even more deeply to the rug or carpet support. Thus, rather long drying periods are required during which time the rug or carpet must not be walked on or otherwise it will become soiled again. The excessive wetness also has a deleterious effect on the carpet backing. The water in these compositions swells hydrophilic textile fibers such as wool and cotton, which can occasion irreversible structural changes in the fiber resulting in a deterioration of its appearance, which becomes dull and lusterless. Furthermore, while aqueous emulsions exhibit good cleaning effectiveness as regards water-based spots and soils, they are hardly suitable for cleaning common oil-based soils. In addition, the residual product left in the carpet contains surfactant which has an affinity for dirt and thus increases the rate of soiling. Leaching or migration of the dyes or finishing agents may also be experienced as may staining or shrinking of the textile material.

Other types of formulations are reflected in such patents as U.S. Pat. Nos. 2,344,247, 2,344,268, 4,035,148 and 4,090,974.

It is, therefore, the primary object of this invention to provide a composition for the maintenance of textile materials such as rugs and carpets which does not have the drawbacks inherent in the hitherto known liquid and aqueous compositions.

It is a further object to provide a formulation which is suitable for effectively cleaning rugs and carpets and which imparts antistatic, antisoiling and possibly antimicrobial properties.

Still another object is to provide a formulation in a non-liquid form which can be readily applied to and removed from the carpet surface.

Various other objects and advantages of this invention will become apparent from the following description thereof.

It has now been determined that by preparing a free flowing, semi-dry powdered blend comprising, in specified concentrations, an absorbent borax support system and a cleaning system of an ether alcohol cleaning solvent and a surfactant, and optionally an anti-static agent, the above noted characteristics for a carpet cleaning composition are substantially achieved. The formulation is in semi-dry form and very easy to dispense. It is formulated to loosen dirt from the carpet fibers but not to adhere to the fibers. The formulation is designed to readily remove both water-based and oil-based soils from the carpet fibers. Excessive wetness is not encountered, so that when the product is removed from the carpet by vacuum, the carpet is ready for immediate use. Correspondingly, there are no deleterious effects to the carpet structure, particularly the backing, which may result from excessive wetting. The carpet is cleaner and retains the look of a new carpet rather than the matted look of a shampooed carpet. Unlike other carpet cleaners, residual product in the carpet after vacuuming serves an important and positive purpose. Thus, the residual product can serve to impart both anti-static and anti-soil redeposition properties. Accordingly, the instant formulations exhibit both immediate and residual effectiveness.

These compositions are characterized in that they are in the form of a powder formed by mixing approximately 80 to 98.5%, by weight, of a borax carrier and a primary cleaning system comprising approximately 1.0 to 10.0%, by weight, of an ether alcohol cleaning solvent and approximately 0.5 to 10.0%, by weight, of a surfactant, all of these percentages relating to the total weight of the composition and being based on a three-component system.

The primary carrier for the instant formulations is borax, for example, in decahydrate form or as decahydrated sodium tetaborate. The term "borax", as utilized herein, is intended to include all of its possible forms. The basic feature of the borax is that it is capable of increasing the apparent density of the cleaning formulation and of existing in agglomerated form so as to facilitate the application of the formulation onto the carpet surface without excessive dusting or uneven distribution. It also serves to enhance and facilitate the cleaning performance and the subsequent removal of the formulation. Of prime importance, the borax will not adhere to the carpet regardless of the moisture content of the formulation of the amount of water applied to it during the cleaning operation. Accordingly, it may be readily removed from the carpet by vacuuming without reducing the efficiency of the vacuuming operation, as by clogging of the system. The borax carrier is present in a concentration of from about 80.0 to 98.5%, by weight of the total composition. Although as noted hereinbelow, the presence of optional ingredients will lower the borax concentration, at least about 40%, by weight of borax is necessarily present in the instant formulations.

For example, a maximum of about 50%, by weight, of said borax may be replaced by one or more secondary carriers such that at least 40%, by weight of the total formulation will consist of borax. The secondary carriers for the instant formulations are selected from inorganic salts such as the alkali and alkaline-earth metal borates, sulfates, chlorides, carbonates, bicarbonates, citrates, phosphates and nitrates, as well as various aluminum salts. Specific carriers include sodium sulfate, sodium chloride, sodium carbonate, sodium bicarbonate, sodium citrate, sodium tripolyphosphate, sodium nitrate and alumina. Blends of one or more of the above identified secondary carriers can also be used. For example, certain salts can be included so as to contribute to the product density and further facilitate the agglomerate form sitting on the surface of the carpet fibers. Such salts can also aid in absorbing the liquid components of the formulation.

The primary cleaning system comprises ether alcohols and surfactants. The ether alcohols which funtion as the cleaning solvent in the compositions according to the invention include for example, ethylene glycol monomethyl ether, diethylene glycol monomethyl ether, propylene glycol momomethyl ether, dipropylene glycol monomethyl ether, ethylene glycol monoethyl ether, diethylene glycol monoethyl ether, ethylene glycol monobutyl ether or mixtures of at least two of these solvents. The dipropylene glycol monomethyl ether and ethylene glycol monobutyl ether are preferred. The ether alcohols have the advantage of increasing the range of effectiveness of the compositions in accordance with the invention by making it possible to eliminate at one and the same time oil-based soils and water-based soils. In addition, their presence in the instant formulations provide an increase in cleaning effectiveness and efficiency beyond that which might be ordinarily anticipated from the individual cleaning ingredient.

The surfactant component of the cleaning system can be selected from all four basic groups of surface active agents, in either liquid or solid form, including anionic, non-ionic, cationic and amphoteric surfactants, including mixtures thereof having appropriate blends of cleaning properties. The non-ionic surfactants are preferred for use in the instant formulations in view of their performance in the removal of oil-based soils.

The non-ionic detergents comprise surfactants having alkylene oxide groups which are hydrophilic in nature combined with an organic hydrophobic group. The preferred class includes the ethoxylation products of hydrophobic hydroxyl compounds such as long chain aliphatic compounds and alkylaromatic compounds. Among such materials are the polyethylene oxide condensates of aliphatic alcohols having, for example, 8 or more (e.g. 8–22) carbon atoms, such as lauryl or tallow alcohols, combined with, for example, 3–30 moles of ethylene oxide for each mole of the long chain alcohol.

Other non-ionic detergents are the polyethylene oxide condensates of alkyl phenols, having, for example, an alkyl group of about 6 to 12 carbon atoms (e.g. nonyl phenyl) in which there are a plurality of ethylene oxide units (e.g. up to 60) per mole of alkyl phenol. Another class of non-ionic detergents includes the polyethylene oxide condensates of higher glycols, which may be made, for example, by condensing ethylene oxide with a polypropylene glycol made by reacting propylene oxide and propylene glycol, said polypropylene glycol having a molecular weight of 1500–1800.

Examples of anionic surfactants are water-soluble salts, particularly alkali metal salts of sulfate esters or sulfonates containing higher aliphatic hydrocarbon radicals of 8 or more carbon atoms (e.g. 8–22 carbon atoms); such as sodium or potassium sulfates of higher alcohols (e.g. sulfates of alkanols such as coco alcohol or sulfates of other higher alcohols such as the higher alkyl phenol-ethylene oxide ether sulfates or the higher fatty acid monoglyceride sulfates or the ethoxylated higher fatty alcohol sulfates), sodium or potassium salts of higher sulfonic acids (e.g. of higher alkylbenzene sulfonic acids such as pentadecyl benzene sulfonic acid, or of isothionate esters of higher fatty acids such as coconut oil fatty acids).

Examples of cationic detergents are quaternary ammonium compounds in which there is a quaternary nitrogen atom directly linked to a carbon atom of a hydrophobic radical of at least ten carbon atoms (e.g. a long chain alkyl radical or an alkylaryl radical, in which there are 10–12 carbon atoms), three valences of the nitrogen atom being also directly linked to other carbon atoms which may be in separate radicals (such as alkyl, particularly lower alkyl, or aralkyl radicals) or in a cyclic structure including the quaternary nitrogen (as in a morpholine, pyridine, quinoline or imidazoline ring); stearyl trimethyl ammonium chloride being a specific example.

Examples of amphoteric detergents are tertiary amine oxide salts having a hydrophobic radical (such as a hydrocarbon radical of 10–18 carbon atoms) attached to the nitrogen atom. Other examples are amino acids having a similar hydrophobic radical attached to the nitrogen atom of the amino acid such as N-lauryl aminoproionic acid, and quaternary imidazolinium salts. Complete information on all applicable surface active agents may be found in "Systematic Analysis of the Surface Active Agents" by Rosen and Goldsmith, 2nd Edition, Wiley-Interscience, 1972 and McCutcheon's "Detergents and Emulsifiers".

The low level use of surfactant herein provides effective anti-soiling properties without the adverse effects previously associated with such surfactants.

It should be noted that many of the applicable ingredients of the instant formulations contribute characteristics other than those for which these ingredients are specifically designated. Most particularly, borax and many of the secondary carriers such as sulfates, carbonates, citrates, phosphates and alumina, contribute to the excellent cleaning activity of the instant formulations.

As previously noted, for the three component system the carrier will be present in concentrations ranging from about 80.0 to 98.5%, the ether alcohol from about 1.0 to 10.0% and the surfactant from about 0.5 to 10.0%, all percentages being based on the total weight of composition. Preferred ranges include 80.0 to 90.0% of carrier, 4.0 to 80% of ether alcohol, and 1 to 3% of surfactant. With more than three components, the preferred carrier range is 60 to 85%, by weight.

For purposes of this invention, the particle size distribution of the final product should be such that substantially all the particles fall within the range 0.06–0.44 mm. (−20+230 U.S. Standard Sieve Series). In this manner, the very fine and very coarse particles which would tend to interfere with the efficient application, retention, cleaning and removal of the final product are eliminated. Correspondingly, this particle size range minimizes the potential for clogging of the vacuum bag. Such particle size distribution will generally be attained by the proper choice of the components, although screening or a variation in processing can achieve a comparable result.

The compositions in accordance with the invention may optionally contain a maximum of about 25%, calculated with respect to the total weight of the composition, of an agent which imparts anti-static properties and, correspondingly, reduces soil retention and redeposition. Such agents include aluminum oxides and nonionic and preferably anionic, amphoteric and cationic materials such as quaternary ammonium chlorides, bromides, or sulfates; cationic quaternary ammonium salts and imidazolium salts; amphoteric tertiary ammonium compounds; nonionic compounds such as tertiary amide oxides, ethoxylated alcohols and alkyl phenols, ethoxylated amines, and tertiary phosphine oxides; anionic soaps; sulfates, and sulfonates, i.e. fatty acid soaps, ethoxylated alcohol sulfates, sodium alkyl sulfates, alkyl sulfonates, sodium alkyl benzene sulfonates, and sodium or potassium alkyl glyceryl ether sulfonates; and zwitterionic quaternary ammonium compounds. The antistatic and antisoiling agent which is preferred in the compositions in accordance with the invention is aluminum oxide due to the fact that it imparts anti-static and anti-soiling properties to both natural and synthetic carpet fibers and contributes to the anti-caking and vacuumability characteristics of the final compositions.

The compositions in accordance with the invention may likewise contain other optional adjuvants such as scents, bactericidal agents, agglomerating agents, and the like. The presence of these various agents, including the anti-stat, may lower the borax concentration below the indicated 80%.

The preparation of the compositions in accordance with the invention is effected by simply mixing the powdery components in a conventional powder mixer. When the pulverulent support system is thoroughly homogeneous, the solvent and other liquid ingredients are added and mixing is continued until the powder again becomes homogeneous. After sifting, and screening if required, a semi-dry fluid (flowable) powder is obtained which gives off practically no dust when it is spread on a rug or carpet and whose different particles have practically no increased tendency to become agglomerated when stored for a prolonged period.

In order to clean a rug or carpet with a composition in accordance with the invention, approximately from 10 to 50 grams, and preferably from 25 to 40 grams, of the product per square meter of a rug or carpet are spread evenly, and then the product is rapidly distributed over the whole surface of the rug or carpet by rubbing with a damp cloth or mop. The spreading of the product as well as the presence of the solvent component loosen and solubilize the dirt from the carpet fibers. The semi-dry composition is then practically invisible. After from about five to forty five minutes of drying time and solvent evaporation, the powder once again becomes visible. It does not adhere to the rug and can be vacuumed immediately and easily without leaving any traces; the rug or carpet thus treated having a clean, aired and renewed appearance. There are, however, no adverse effects if there is an interval of time between drying and vacuuming. In either event, the carpet is dry and available for immediate use. A minute amount of product is retained in the carpet in order to provide residual anti-static and anti-soiling properties.

The use of a composition in accordance with the invention has numerous advantages. It is possible without significant wetting to effectively clean a rug or carpet in a few minutes. Due to the fact that complete drying takes place rapidly (generally within less than thirty minutes), the rug or carpet can be walked on immediately after vacuuming without any danger of adverse effects. This drying is very rapid owing to the fact that the powdery composition in accordance with the invention remains on the fibers of the rug or carpet where soil marks are located and in no way wets the carpet backing which always takes longer to dry. The absence of excess wetness also avoids any detrimental effects to the backing structure.

A further advantage in using a composition in accordance with the invention resides in the fact that there is no danger of its forming halos, which very frequently happens with compositions in the form of solutions or foams. Moreover, the dust and soil marks which are detached from the fibers during treatment are immediately absorbed by the powdery support and there is no danger that they will be redeposited, leaving the rug dull and lusterless. Furthermore, the compositions allow for the ready removal of oil-based soils, which are the most common and which essentially-aqueous shampoos eliminate only very partially. The treatment with this composition leaves the rug or carpet with a lasting, clean, aired look. It is characterized by soil resistance, which is not the case with rugs or carpets treated with aqueous shampoos.

The use of the composition is further advantageous due to the fact that it does not require any special application apparatus. It is suitable for any and all types of vegetable, animal or synthetic fibers, such a wool, cotton, jute, silk, regenerated cellulose, rayon acetate, polyamide, polyester, polyolefin, and polyvinylidene chloride fibers, polyacrylic fibers and mixtures of these fibers.

The compositions are suitable for the maintenance of all types of rugs and carpets, such as hooked rugs, felted or matted rugs, and in particular long-pile or shag rugs, which are always very difficult to maintain with compounds in liquid or foam form due to the fact that these products tend to clump the pile together.

The following examples will further illustrate the embodiment of this invention. In these examples, all parts are given by weight unless otherwise noted.

EXAMPLE 1

This example illustrates the preparation of a typical composition of the instant invention.

The formulation described below was prepared by mixing the solids of the formulation until a homogeneous blend was achieved. This blend was then placed in a mixing vessel, the total quantity of liquid was added, the vessel sealed and the blend further mixed for a period of ½ hour. As agglomerated substantially dust free product was obtained having a particle size distribution of −20+230 mesh.

The following component blend was utilized:

| | parts |
|---|---|
| Sodium borate decahydrate | 80.35 |
| Aluminum oxide | 12.00 |
| Dipropylene glycol monomethyl ether | 6.00 |
| Polyethylene glycol of linear alcohol (non-ionic surfactant) | 1.50 |
| Fragrance | 0.15 |

The formulation thus obtained exhibited good flow characteristics. It was well-suited for cleaning rugs or carpets with oil- and water-based soils. These soils were immediately absorbed by the semi-dry powder and did not leave any halo after treatment. The formulation did not adhere to the rug or carpet and was rapidly and substantially totally removed by means of ordinary vacum cleaning.

EXAMPLE 2

This example illustrates the necessity for the presence of borax in the instant formulations.

The test was conducted by applying ¼ of a teaspoon of each of the selected materials to an area of carpeting of about 2½"×3". A short-cut pile, nylon carpet was utilized for this purpose. Cellulose sponges of equal size were then utilized to distribute the material. The amount of water maintained in the sponge was measured such that a "low water level" reflected five milliliters; "medium water level" reflected ten milliliters; and "high water level" reflected fifteen milliliters. The sponge was placed over the distributed material and an eight pound weight placed thereon for a period of 15 seconds. The carpet was allowed to dry, with vacuuming and rating being conducted after a period of 4½ hours, allowed to dry overnight for about an additional twelve hours and vacuumed again. The carpet was observed at each intervening period and given a rating from 0–10, with "0" reflecting a dry, substantially composition-free carpet and "10" reflecting a wet, clumped carpet. The following results were obtained:

TABLE I

| | Low Water | | | Med. Water | | | High Water | | |
|---|---|---|---|---|---|---|---|---|---|
| | Night | Morn | Revac Morn | Night | Morn | Revac Morn | Night | Morn | Revac Morn |
| Borax | 1 | 1 | trace | 1 | 1½ | trace | 1 | trace | trace |
| Silica powder | trace | trace | 0 | 1½ | 1 | trace | 8 | 6 | 1 |
| Sodium tripoly-phosphate | 2 | 2 | 1 | 6 | 6 | 6 | 7 | 8 | 9 |
| Calcium carbonate | 8 | 7 | trace | 4 | 4 | 1 | 8 | 9 | 7 |
| Aluminum sulfate | 1½ | 1 | 1 | 5 | 6 | 4 | 7 | 6 | 7 |
| Calcium phosphate | 5 | 5 | 6 | 9 | 9 | 9 | 8 | 9 | 8 |
| Dicalcium phos-phate | 3 | 3 | 1 | 9 | 9 | 3 | 8 | 8 | 5 |
| Solid polyethylene glycol (4000) | 1 | 1 | trace | 8 | 8 | 8 | 2 | trace | 1 |
| Aluminum oxide | trace | trace | trace | 1 | 1 | 1 | 8 | 8 | 2 |
| Oat Flour | 5 | 6 | 3 | 9 | 9 | 9 | 9 | 9 | 9 |
| Starch | 3 | 4 | 2 | 9 | 9 | 9 | 9 | 8 | 8 |
| Sodium bicarbonate | 4 | 5 | 2 | 9 | 9 | 5 | 5 | 7 | 6 |

The procedure was repeated with additional materials under medium water conditions, the one most likely to be encountered in household use, with the carpet being evaluated immediately after wetting and then again after a drying period with subsequent vacuuming. This test procedure was intended to reflect solely on this one important characteristic required in the instant formulations, and the potential for a combined carrier system utilizing borax.

TABLE II

| | Wet | Revac Dry |
|---|---|---|
| Unpuffed base/Borax | 8 | 3 |
| Sodium sulfate (powder) | 9 | 7 |

TABLE II-continued

| | Wet | Revac Dry |
|---|---|---|
| Sodium sulfate (granular) | 3 | 1 |
| Borax (powder) | 7 | trace |
| Urea | 4 | 3 |
| Commercial borax | 6 | 0 |
| Zinc Stearate | 4 | 2 |
| Talcum | 9 | 7 |
| Aluminum Oxide | 9 | 8 |
| Sodium Carbonate | 8 | 8 |

The test results indicated that borax is a necessary ingredient inasmuch as it can be readily and totally vacuumed under all water conditions likely to be encountered in household use.

EXAMPLE 3

The following formulations were prepared according to the procedure of Example 1.

| | parts | | | | | | | | | |
|---|---|---|---|---|---|---|---|---|---|---|
| | 2 | 3 | 4 | 5 | 6 | 7 | 8 | 9 | 10 | 11 |
| Sodium borate decahydrate | 80.3 | 81.0 | 80.43 | 80.0 | 65.0 | 83.0 | 84.0 | 82.35 | 85.0 | 86.0 |
| Aluminum oxide | 12.0 | 12.0 | 12.0 | 12.0 | 12.0 | 12.0 | 12.0 | 12.0 | 12.0 | 12.0 |
| Ethylene glycol monoethyl ether | 6.0 | 6.0 | 6.0 | 6.0 | 6.0 | — | — | — | 2.0 | — |
| Dipropylene glycol monoethyl ether | — | — | — | — | — | 4.0 | 3.0 | 4.0 | — | 1.0 |
| Polyethylene glycol of linear alcohol (non-ionic) | 1.0 | 1.0 | 1.0 | 1.0 | 1.0 | 1.0 | 1.0 | 1.0 | 1.0 | 1.0 |
| Fragrance | 0.5 | — | 0.50 | 1.0 | — | — | — | 0.15 | — | — |
| Brightener | 0.2 | — | 0.07 | — | — | — | — | — | — | — |
| Sodium sulfate | — | — | — | — | 16.0 | — | — | — | — | — |
| Silicon dioxide | — | — | — | — | — | — | — | 0.50 | — | — |

These formulations also exhibited a broad range of acceptable properties and performance characteristics.

EXAMPLE 4

Additional formulations were prepared according to procedure of Example 1.

| | 12 | 13 | 14 | 15 | 16 | 17 | 18 | 19 | 20 |
|---|---|---|---|---|---|---|---|---|---|
| Sodium borate decahydrate | 92.5 | 80.85 | 78.35 | 82.2 | 80.85 | 78.85 | 76.85 | 80.85 | 79.85 |
| Aluminum oxide | — | 12.0 | 12.0 | 12.0 | 12.0 | 12.0 | 12.0 | 12.0 | 12.0 |
| Dipropylene glycol mono-ethyl ether | 6.0 | 4.0 | 4.0 | 4.0 | 6.0 | 8.0 | 10.0 | 4.0 | 4.0 |
| Polyethylene glycol of linear alcohol (non-ionic) | 1.5 | 1.0 | 1.0 | 1.0 | 1.0 | 1.0 | 1.0 | 2.0 | 3.0 |

-continued

| | | | | | | | | | |
|---|---|---|---|---|---|---|---|---|---|
| Sodium lauryl sulfate (anionic) | — | — | — | — | — | — | — | — | — |
| Sodium stearate (anionic) | — | — | — | — | — | — | — | — | — |
| Dimethyl distearyl ammonium chloride (cationic) | — | — | — | — | — | — | — | — | — |
| Dicarboxylic coconut derivative monoethanol amine salt (amphoteric) | — | — | — | — | — | — | — | — | — |
| Fragrance | — | 0.15 | 0.15 | 0.3 | 0.15 | 0.15 | 0.15 | 0.15 | 0.15 |
| Silicon dioxide | — | 2.0 | 4.5 | — | — | — | — | — | — |
| Anti-caking agent | — | — | — | 0.5 | — | — | — | 1.0 | 1.0 |

| | 21 | 22 | 23 | 24 | 25 | 26 | 27 | 28 | 29 |
|---|---|---|---|---|---|---|---|---|---|
| Sodium borate decahydrate | 81.85 | 86.85 | 80.35 | 80.35 | 80.35 | 80.35 | 40.0 | 50.0 | 60.0 |
| Aluminum oxide | 10.0 | 5.0 | 12.0 | 12.0 | 12.0 | 12.0 | 12.0 | 12.0 | 12.0 |
| Dipropylene glycol monoethyl ether | 6.0 | 6.0 | 6.0 | 6.0 | 6.0 | 6.0 | 6.0 | 6.0 | 6.0 |
| Polyethylene glycol of linear alcohol (non-ionic) | 1.0 | 1.0 | — | — | — | — | 1.5 | 1.5 | 1.5 |
| Sodium lauryl sulfate (anionic) | — | — | 1.5 | — | — | — | — | — | — |
| Sodium stearate (anionic) | — | — | — | 1.5 | — | — | — | — | — |
| Dimethyl distearyl ammonium chloride (cationic) | — | — | — | — | 1.5 | — | — | — | — |
| Dicarboxylic coconut derivative monoethanol amine salt (amphoteric) | — | — | — | — | — | 1.5 | — | — | — |
| Fragrance | 0.15 | 0.15 | 0.15 | 0.15 | 0.15 | 0.15 | 0.15 | 0.15 | 0.15 |
| Silicon dioxide | — | — | — | — | — | — | — | — | — |
| Anti-caking agent | 1.0 | 1.0 | — | — | — | — | — | — | — |
| Sodium sulfate | — | — | — | — | — | — | 40.35 | 30.35 | 20.35 |

| | 30 | 31 | 32 | 33 | 34 | 35 | 36 | 37 | 38 | 39 |
|---|---|---|---|---|---|---|---|---|---|---|
| Sodium borate decahydrate | 70.0 | 90.35 | 98.5 | 78.35 | 76.35 | 81.35 | 77.35 | 75.35 | 73.35 | 71.85 |
| Aluminum oxide | 12.0 | 2.0 | — | 12.0 | 12.0 | 12.0 | 12.0 | 12.0 | 12.0 | 12.0 |
| Dipropylene glycol monoethyl ether | 6.0 | 6.0 | 1.0 | 8.0 | 10.0 | 6.0 | 6.0 | 6.0 | 6.0 | 6.0 |
| Polyethylene glycol of linear alcohol (non-ionic) | 1.5 | 1.5 | 0.5 | 1.5 | 1.5 | 0.5 | 4.5 | 6.5 | 8.5 | 10.0 |
| Sodium lauryl sulfate (anionic) | — | — | — | — | — | — | — | — | — | — |
| Sodium stearate (anionic) | — | — | — | — | — | — | — | — | — | — |
| Dimethyl distearyl ammonium chloride (cationic) | — | — | — | — | — | — | — | — | — | — |
| Dicarboxylic coconut derivative monoethanol amine salt (amphoteric) | — | — | — | — | — | — | — | — | — | — |
| Fragrance | 0.15 | 0.15 | — | 0.15 | 0.15 | 0.15 | 0.15 | 0.15 | 0.15 | 0.15 |
| Silicon dioxide | — | — | — | — | — | — | — | — | — | — |
| Anti-caking agent | — | — | — | — | — | — | — | — | — | — |
| Sodium sulfate | 10.35 | — | — | — | — | — | — | — | — | — |

These formulations will also exhibit a broad range of acceptable properties and performance characteristics.

EXAMPLE 5

The following testing procedure may be utilized to determine the cleaning and resoiling properties of the instant formulations.

A carpet divided into three adjacent, equal sections of 30"×48" is placed in an area of heavy foot traffic. Each section is treated with 39 grams of test cleaner. The rug is rotated daily to give uniform soiling, vacuumed and subjected to reflectance determination with a Photovolt Reflection Meter. Electric eye counters are utilized to monitor pedestrian traffic. When subjected to this test, the carpet section treated with the formulation of Example 1 was found to be exceptionally clean after vacuuming in contrast to an untreated section. Correspondingly, the untreated section exhibited a substantial reflectance loss in comparison to the treated section, thus indicative of less soiling after treatment with the novel formulation of this invention.

Summarizing, it is seen that this invention provides an improved carpet cleaning composition. Variations may be made in proportions, procedures and materials without departing from the scope of the invention as defined by the following claims.

What is claimed is:

1. A powdered carpet cleaning composition comprising a blend of from about 40.0 to 98.5%, by weight, of a borax carrier and a primary cleaning system comprising from about 1.0 to 10.0%, by weight, of an ether alcohol cleaning solvent and from about 0.5 to 10.0%, by weight, of a surfactant, substantially all of the particles of said composition being between 0.06 to 0.44 millimeters, all percentages based on the total composition weight.

2. The composition of claim 1, wherein said borax carrier is sodium borate decahydrate.

3. The composition of claim 1, wherein a portion of said borax is replaced by an inorganic salt carrier selected from the group consisting of alkali and alkaline-earth metal borates, sulfates, chlorides, carbonates, bicarbonates, citrates, phosphates, nitrates, alumina, and blends thereof, the remaining borax content of the composition after replacement being at least about 40%, by weight.

4. The composition of claim 1, wherein said carrier is present in a concentration of from about 80.0 to 98.5%, by weight.

5. The composition of claim 3, wherein said carrier is present in a concentration of from about 60 to 85%, by weight.

6. The composition of claim 1, wherein said ether alcohol is selected from the group consisting of ethylene glycol monomethyl ether, diethylene glycol monomethyl ether, propylene glycol monomethyl ether, dipropylene glycol monomethyl ether, ethylene glycol monoethyl ether, diethylene glycol monoethyl ether, ethylene glycol monobutyl ether and blends thereof.

7. The composition of claim 6, wherein said ether alcohol is dipropylene glycol monomethyl ether or ethylene glycol monobutyl ether.

8. The composition of claim 1, wherein said carrier is sodium borate decahydrate and said ether alcohol is dipropylene glycol monomethyl ether.

9. The composition of claim 1 which also contain an effective amount up to about 25.0%, by weight, of an antistatic agent.

10. The composition of claim 9, wherein said antistatic agent is aluminum oxide.

11. The composition of claims 1 or 8 or 10, wherein said surfactant is a non-ionic surfactant.

12. The composition of claim 1, which contains 80.0 to 90.0% of carrier, 4.0 to 8.0% of ether alcohol and 1.0 to 3.0% of surfactant, all percentages being based on the total weight of the composition.

13. The composition of claim 11, which contains 80.35% sodium borate decahydrate, 12.0% aluminum oxide, 6.0% dipropylene glycol monomethyl ether, 1.5% of a non-ionic surfactant and 0.15% fragrance, said percentages being based on the total weight of said composition.

14. A powdered carpet cleaning composition comprising a blend of

| | parts by weight |
|---|---|
| sodium borate decahydrate | 80.35 |
| aluminum oxide | 12.00 |
| dipropylene glycol monomethyl ether | 6.00 |
| polyethylene glycol of linear alcohol nonionic surfactant | 1.50 |
| fragrance | 0.15 |

substantially all of the particles of said composition being between 0.06 to 0.44 millimeters.

15. A flowable powdered semi-dry carpet cleaning composition comprising from about 60 to 90%, by weight, of an absorbent borax carrier, from about 1 to 10%, by weight, of ether alcohol cleaning solvent and from about 0.5 to 10%, by weight, of a surfactant, said ether alcohol and surfactant comprising the primary cleaning system of said composition, substantially all of the particles of said composition being between 0.06 to 0.44 millimeters, wherein said composition is adapted for application onto a carpet and for removal by vacuuming.

16. The composition of claims 1 or 15 comprising an effective amount of anti-caking agent.

17. The composition of claim 15 comprising an effective amount of an anti-static and anti-caking agent.

18. The composition of claim 16 wherein said surfactant is an alkylene oxide non-ionic surfactant.

19. The composition of claim 17 wherein said surfactant is a non-ionic surfactant.

20. A method for treating natural and synthetic carpets so as to clean said carpets and impart anti-soil redeposition characteristics thereto, which comprises applying to the carpet surface an effective amount of the composition according to claim 1, distributing said composition over the carpet surface and into the carpet fibers by means of a moisture-containing applicator, maintaining said composition in contact with said carpet for a period of time sufficient to loosen and solubilize the dirt thereon, and thereafter removing said composition.

21. A method for treating natural and synthetic carpets so as to clean said carpets and impart anti-soil redeposition characteristics thereto, which comprises applying to the carpet surface an effective amount of the composition according to claim 8, distributing said composition over the carpet surface and into the carpet fibers by means of a moisture-containing applicator, maintaining said composition in contact with said carpet for a period of time sufficient to loosen and solubilize the dirt thereon, and thereafter removing said composition.

22. The method of claim 21, wherein said surfactant is a non-ionic surfactant.

23. A method for treating natural and synthetic carpets so as to clean said carpets and impart anti-static and anti-soil redeposition characteristics thereto, which comprises applying to the carpet surface an effective amount of the composition according to claim 10, distributing said composition over the carpet surface and into the carpet fibers by means of a moisture-containing applicator, maintaining said composition in contact with said carpet for a period of time sufficient to loosen and solubilize the dirt thereon, and thereafter removing said composition.

24. The method of claim 22, wherein said surfactant is a non-ionic surfactant.

25. A method for treating natural and synthetic carpets so as to clean said carpets and impart anti-static and anti-soil redeposition characteristics thereto, which comprises applying to the carpet surface an effective amount of the composition according to claim 13, distributing said composition over the carpet surface and into the carpet fibers by means of a moisture-containing applicator, maintaining said composition in contact with said carpet for a period of time sufficient to loosen and solubilize the dirt thereon, and thereafter removing said composition.

26. A method for treating carpets which comprises applying to the carpet surface an effective amount of a composition according to claims 15 or 17, distributing said composition over the carpet surface and into the carpet fibers by means of a moisture-containing applicator, maintaining said composition in contact with said carpet until substantially dry and thereafter removing said composition by vacuuming.

* * * * *